US007824318B1

(12) United States Patent
Christopher

(10) Patent No.: US 7,824,318 B1
(45) Date of Patent: Nov. 2, 2010

(54) EXERCISE APPARATUS

(76) Inventor: Kenneth M. Christopher, 1034 Noble Rd., Christiania, PA (US) 17509

( * ) Notice: Subject to any disclaimer, the term of this patent is extended or adjusted under 35 U.S.C. 154(b) by 0 days.

(21) Appl. No.: 12/608,404

(22) Filed: Oct. 29, 2009

(51) Int. Cl.
*A63B 26/00* (2006.01)

(52) U.S. Cl. ..... 482/140; 482/142; 482/91

(58) Field of Classification Search ..... 482/142, 482/140, 23, 148, 91, 907, 139, 51, 92; 5/690, 5/417; 446/482; D6/382, 596
See application file for complete search history.

(56) References Cited

U.S. PATENT DOCUMENTS 4,210,322 A * 7/1980 Pritchard ..... 482/23
D284,032 S 5/1986 Wahl et al.
5,474,513 A 12/1995 Carlesimo et al.
5,545,144 A 8/1996 Fryklund et al.
5,558,603 A 9/1996 Simon
5,647,829 A 7/1997 Rivas
5,722,923 A 3/1998 Lui
5,755,647 A 5/1998 Watnik
5,807,220 A * 9/1998 Allis et al. ..... 482/140
6,152,865 A * 11/2000 Beauvoir ..... 482/140
6,478,721 B1 * 11/2002 Hunter ..... 482/140
6,623,270 B1 9/2003 Meldeau
6,689,026 B2 * 2/2004 Almada ..... 482/140
6,699,162 B2 * 3/2004 Chen ..... 482/140

* cited by examiner

*Primary Examiner*—Lori Baker

(57) ABSTRACT

An exercise apparatus includes a flexible panel that has a top side, a bottom side, a first end edge, a second end edge, a first lateral edge and a second lateral edge. A strap is integrally coupled to the first end edge and extends away therefrom. The strap has a distal end with respect to the panel. A coupler releasably secures the strap in a closed loop. A spherical ball is removable positioned in the closed loop. A person may sit upon the top side and utilize the closed loop as a lower back support while exercising.

10 Claims, 4 Drawing Sheets

EXERCISE APPARATUS

BACKGROUND OF THE DISCLOSURE

Field of the Disclosure

The disclosure relates to exercise assisting devices and more particularly pertains to a new exercise assisting device for supporting a person's lower back while a person performs stomach exercises.

SUMMARY OF THE DISCLOSURE

An embodiment of the disclosure meets the needs presented above by generally comprising a flexible panel that has a top side, a bottom side, a first end edge, a second end edge, a first lateral edge and a second lateral edge. A strap is integrally coupled to the first end edge and extends away therefrom. The strap has a distal end with respect to the panel. A coupler releasably secures the strap in a closed loop. A spherical ball is removable positioned in the closed loop. A person may sit upon the top side and utilize the closed loop as a lower back support while exercising.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
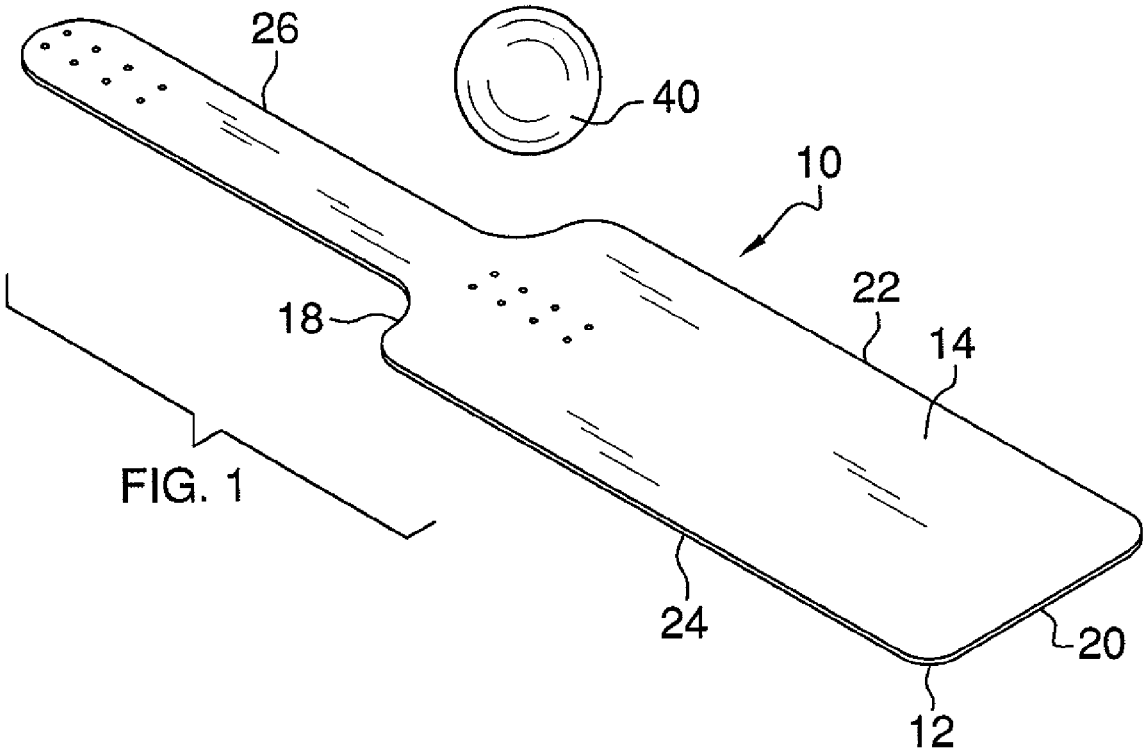
FIG. 1 is a top perspective view of an exercise apparatus according to an embodiment of the disclosure.
Figure 2:
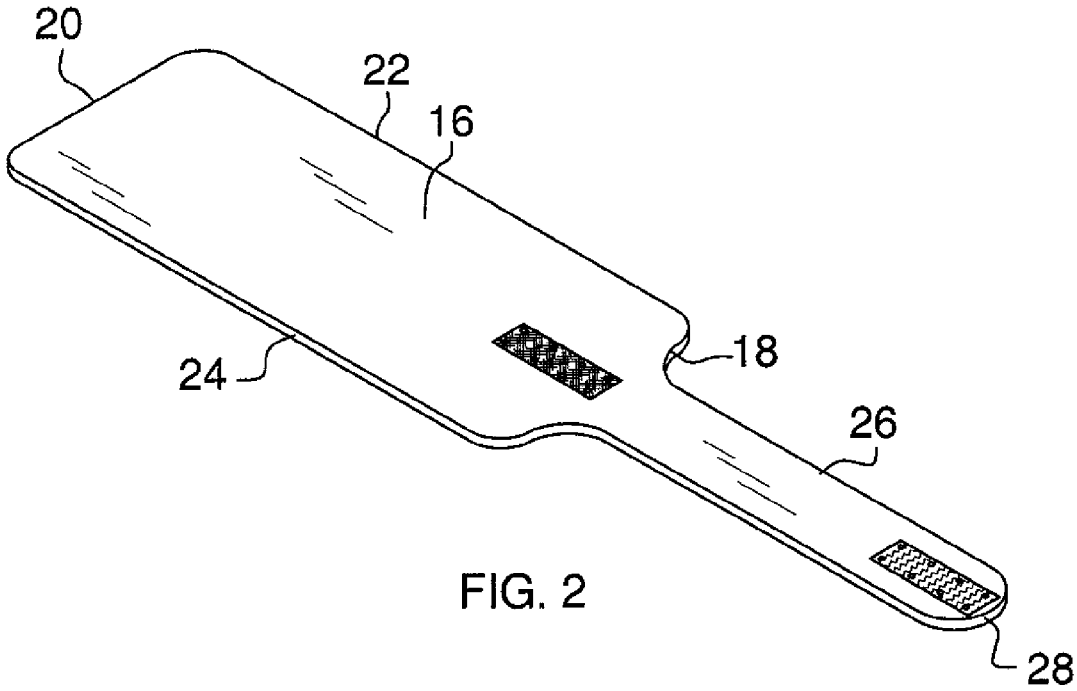
FIG. 2 is a bottom perspective view of an embodiment of the disclosure.
Figure 3:
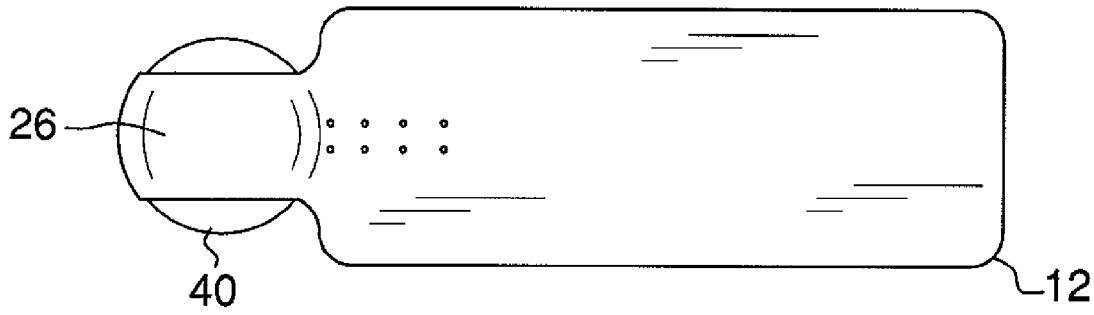
FIG. 3 is a top view of an embodiment of the disclosure.
Figure 4:
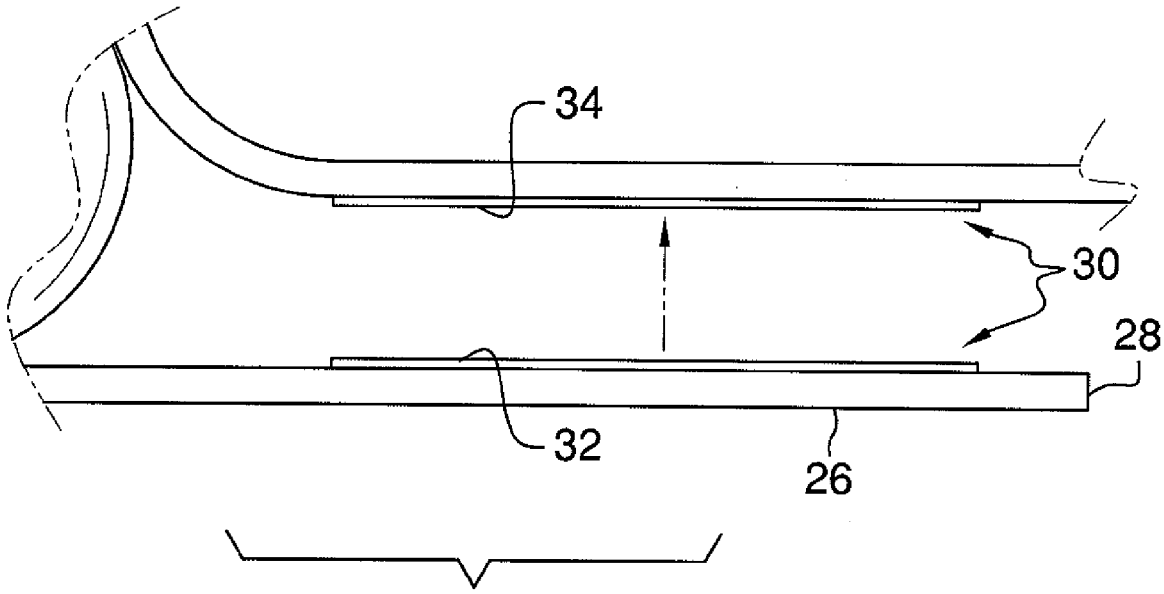
FIG. 4 is a broken side view of an embodiment of the disclosure.
Figure 5:
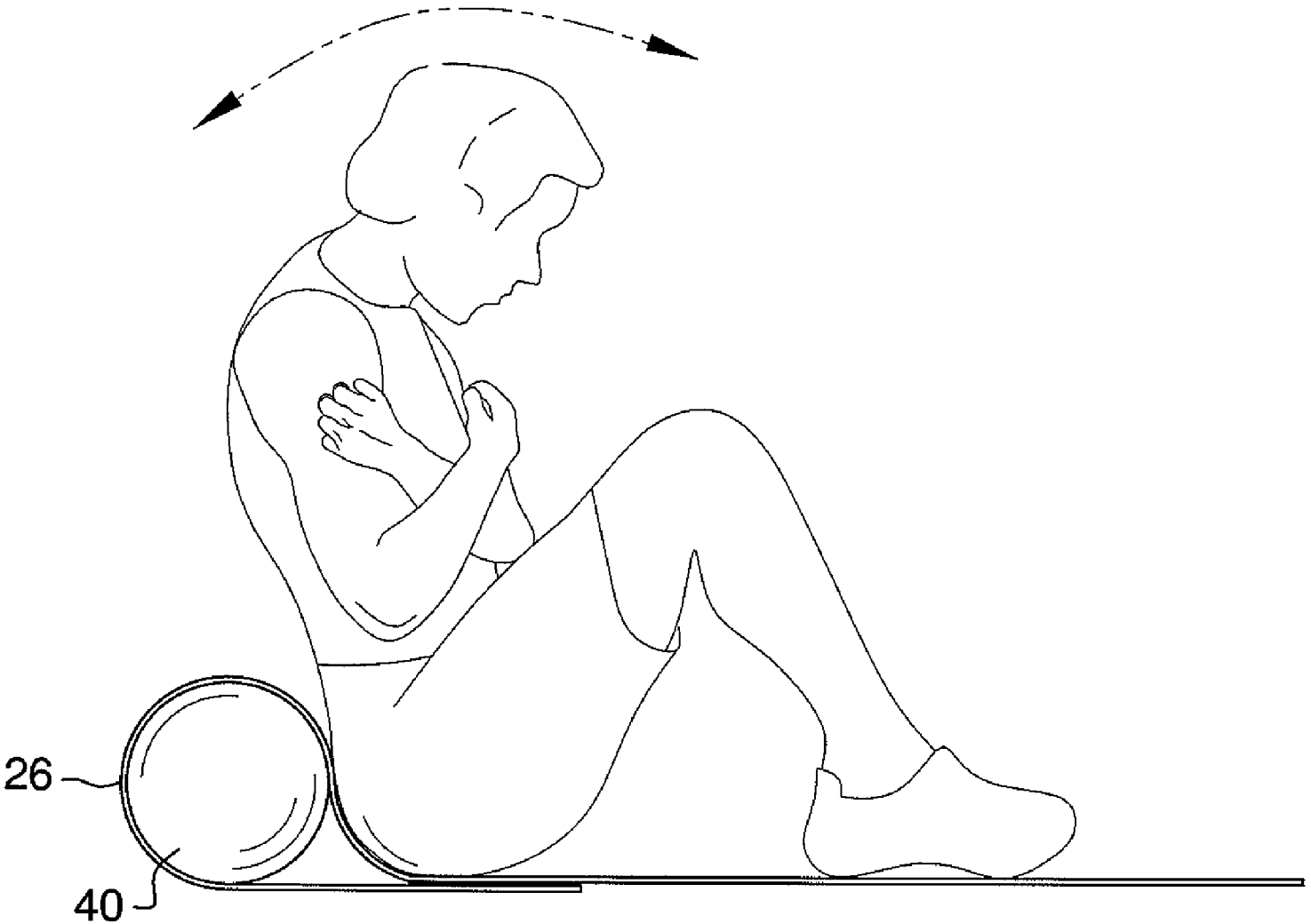
FIG. 5 is a side in-use view of an embodiment of the disclosure.

With reference now to the drawings, and in particular to FIGS. 1 through 7 thereof, a new exercise assisting device embodying the principles and concepts of an embodiment of the disclosure and generally designated by the reference numeral 10 will be described.

As best illustrated in FIGS. 1 through 7, the exercise apparatus 10 generally comprises a panel 12 that has a top side 14, a bottom side 16, a first end edge 18, a second end edge 20, a first lateral edge 22 and a second lateral edge 24. The panel 12 is flexible and may comprise a resiliently compressible material such as a foamed elastomeric material. The panel 12 may have a width from the first lateral edge 22 to the second lateral edge 24 between 12 inches and 24 inches and a length between 36 inches and 54 inches.

A strap 26 is integrally coupled to the first end edge 18 and extends away therefrom. The panel 12 and strap 26 may be formed from a single piece of material so that that strap 26 is non-removable from the panel 12. The strap 26 has a distal end 28 with respect to the panel 12. The strap 26 is equally spaced from the first 22 and second 24 lateral edges and may have a length from the panel 12 to the distal end 28 between 24 inches and 40 inches.

Figure 6:
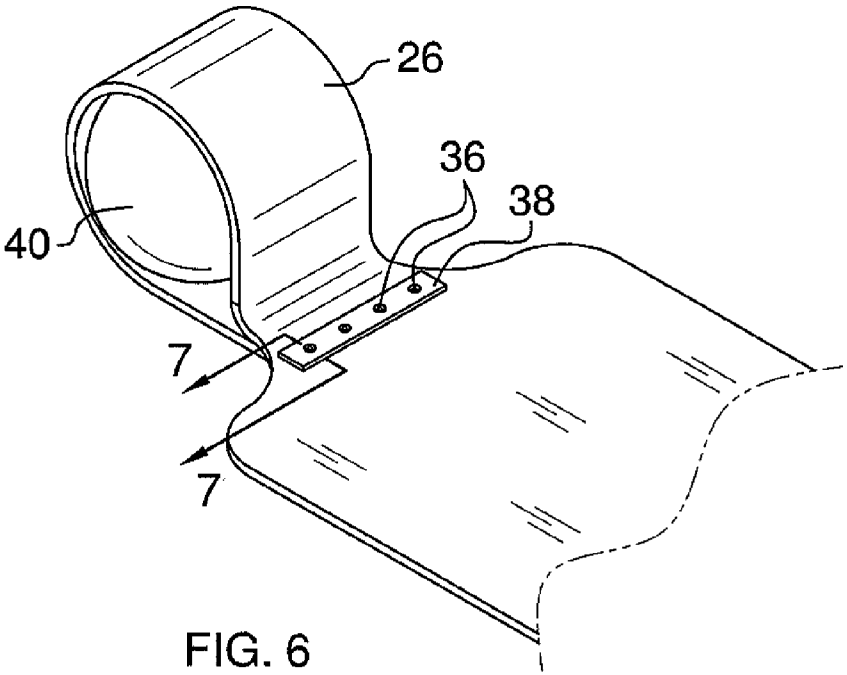
FIG. 6 is a broken top perspective view of an embodiment of the disclosure.
Figure 7:
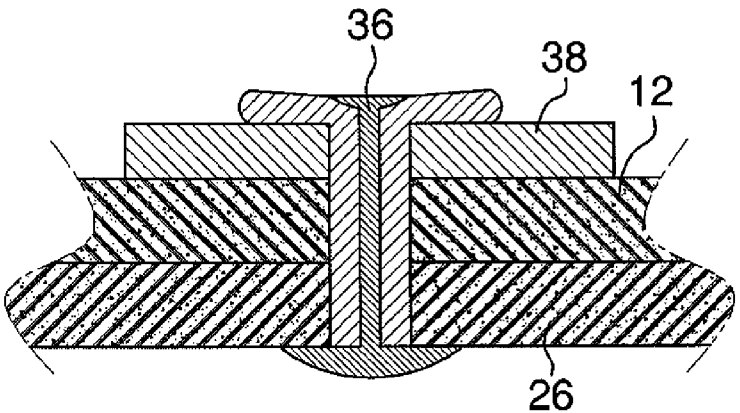
FIG. 7 is a cross-sectional view of an embodiment of the disclosure taken along line 7-7 of FIG. 6.

A coupler 30 is releasably secures the strap 26 in a closed loop. The coupler 30 includes a first mating member 32 attached to a bottom surface of the strap 26 and a second mating member 34 attached to the bottom side 16 of the panel 12. The coupler 30 selectively adjusts a length of an inner perimeter of the closed loop. The coupler 30 may comprise a hook and loop coupler. As shown in FIGS. 6 and 7, the coupler 30 may include fasteners 36 extending through the panel 12 and the strap 26 to fixedly retain the strap 26 in a closed loop configuration. A reinforcing plate 38 may be used to prevent the fasteners 36 from being pulled out or through the panel 12 and the strap 26.

A spherical ball 40 is removable positioned in the closed loop. The ball 40 may have a diameter between 7 inches and 12 inches. The ball 40 may be resiliently compressible. This can be achieved by using an air-inflated ball or a ball comprised of a resiliently compressible material.

In use, a person sits upon the top side 14 of the panel 12 with their back against the strap 26. The person may then perform sit up type stomach exercises while utilizing the ball 40 as a lower back support. The person may arch their back over the ball 40, to hyperextend the muscles of the back, before using their stomach muscles to return themselves to an upright position. The strap 26 prevents the ball 40 from moving during the exercise to ensure stability throughout the exercise movement.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An exercising apparatus comprising:

a compressible panel having a top side, a bottom side, a first end edge, a second end edge, a first lateral edge and a second lateral edge, said panel being flexible;

a strap being integrally coupled to said first end edge and extending away therefrom, said strap having a distal end with respect to said panel, said strap being equally spaced from said first and second lateral edges;

a coupler securing said strap in a closed loop; and a spherical ball being removable positioned in said closed loop, wherein a person may sit upon said top side and utilize said closed loop as a lower back support while exercising.

2. The apparatus according to claim 1, wherein said panel comprises a resiliently compressible material.

3. The apparatus according to claim 1, wherein said strap has a length from said panel to said distal end between 24 inches and 40 inches.

4. The apparatus according to claim 1, wherein said coupler includes a first mating member attached to a bottom surface of said strap and a second mating member attached to said bottom side of said panel, said first and second mating members being releasably coupled together.

5. The apparatus according to claim 4, wherein said coupler selectively adjusts a length of an inner perimeter of said closed loop, said coupler comprising a hook and loop coupler.

6. An exercising apparatus comprising:

a panel having a top side, a bottom side, a first end edge, a second end edge, a first lateral edge and a second lateral edge, said panel being flexible, said panel comprising a resiliently compressible material;

a strap being integrally coupled to said first end edge and extending away therefrom, said strap having a distal end with respect to said panel, said strap being equally spaced from said first and second lateral edges, said strap having a length from said panel to said distal end between 24 inches and 40 inches;

a coupler releasably securing said strap in a closed loop, said coupler including a first mating member attached to a bottom surface of said strap and a second mating member attached to said bottom side of said panel, said coupler selectively adjusting a length of an inner perimeter of said closed loop, said coupler comprising a hook and loop coupler; and a spherical ball being removable positioned in said closed loop, wherein a person may sit upon said top side and utilize said closed loop as a lower back support while exercising, said ball being resiliently compressible.

7. An exercising apparatus comprising:

a panel having a top side, a bottom side, a first end edge, a second end edge, a first lateral edge and a second lateral edge, said panel being flexible;

a strap being integrally coupled to said first end edge and extending away therefrom, said strap having a distal end with respect to said panel;

a coupler securing said strap in a closed loop;

a spherical ball being removable positioned in said closed loop, wherein a person may sit upon said top side and utilize said closed loop as a lower back support while exercising; and a first mating member attached to a bottom surface of said strap and a second mating member attached to said bottom side of said panel, said first and second mating members being releasably coupled together.

8. The apparatus according to claim 7, wherein said panel comprises a resiliently compressible material.

9. The apparatus according to claim 7, wherein said strap is equally spaced from said first and second lateral edges, said strap having a length from said panel to said distal end between 24 inches and 40 inches.

10. The apparatus according to claim 7, wherein said coupler selectively adjusts a length of an inner perimeter of said closed loop, said coupler comprising a hook and loop coupler.

* * * * *